US005499935A

United States Patent [19]

Powell

[11] Patent Number: 5,499,935

[45] Date of Patent: Mar. 19, 1996

[54] RF SHIELDED I/O CONNECTOR

[75] Inventor: Thomas A. Powell, Morristown, N.J.

[73] Assignee: AT&T Corp., Murray Hill, N.J.

[21] Appl. No.: 176,374

[22] Filed: Dec. 30, 1993

[51] Int. Cl.[6] ..... H01R 13/66

[52] U.S. Cl. ..... 439/620; 439/182

[58] Field of Search ..... 333/182, 184; 439/620

[56] References Cited

U.S. PATENT DOCUMENTS

| | | | |
|---|---|---|---|
| 3,134,950 | 5/1964 | Cook | 333/182 X |
| 4,371,742 | 2/1983 | Manly | 174/36 |
| 4,761,147 | 8/1988 | Gauthier | 439/620 X |
| 4,889,750 | 12/1989 | Wiley | 428/34.2 |
| 4,948,922 | 8/1990 | Varadan et al. | 174/35 |
| 5,236,376 | 8/1993 | Cohen | 439/620 |
| 5,266,055 | 11/1993 | Naito et al. | 439/620 |

*Primary Examiner*—Larry I. Schwartz
*Assistant Examiner*—Daniel Wittels

[57] ABSTRACT

An electrical device for propagating an electrical signal which emits radio frequency electromagnetic energy, the electrical device having a medium for propagating the electrical signal and a radio frequency electromagnetic energy absorbing material, radially surrounding a portion of the medium, for attenuating the radio frequency electromagnetic energy emissions generated by the signal.

12 Claims, 5 Drawing Sheets

100

200

400

500

RF SHIELDED I/O CONNECTOR

BACKGROUND OF THE INVENTION

1. Field of the Invention

The present invention relates generally to radio frequency (RF) energy attenuation. More specifically, the present invention relates to attenuating RF energy interference and RF energy emissions from an input/output (I/O) connector using an RF electromagnetic energy absorbing material.

2. Related Art

Interference received within and emissions emanating from electronic instruments, e.g., a linear amplifier, utilizing signals having high frequencies, e.g., radio frequencies (RF), is of great concern. Oftentimes, RF electromagnetic signals, hereafter referred to as "signals", within a first electronic instrument can couple with a second signal where the second signal can be internal to or external to the first electronic instrument. Such coupling can result in significant cross-talk or external interference.

The term "cross-talk" refers to the unintended electromagnetic coupling between signals travelling on wires that are in close proximity and are within the same system, e.g., signals travelling on wires within a connector. In contrast, external interference refers to electromagnetic coupling between a signal travelling on an internal wire and an external electromagnetic source. Some examples of such external electromagnetic sources are discussed below. The general term "interference" refers to cross-talk and external interference.

In the present application the term "emissions" refers to RF electromagnetic energy which emanates from a signal within a primary instrument. The primary instrument is the electronic instrument whose emissions and interference are to be minimized.

Signals which cause interference can enter the primary electronic instrument through a power-supply or through signal input/output (I/O) lines. Signals can also be magnetically coupled to closed loops in the primary instrument, or signals can be electromagnetically coupled to wires acting as small antennas for electromagnetic radiation. Any of these can be a mechanism for coupling signals from one part of a primary instrument to another.

Reducing RF interference is a significant concern when designing and manufacturing electronic instruments. It is imperative to reduce RF interference when designing electronic instruments that will be used in close proximity to other electronic instruments. This is because the primary instrument is often initially tested without other instruments in close proximity. When the primary instrument is delivered to a location where it is to be used, interference from other instruments can significantly degrade the primary instrument's performance.

Numerous techniques are used to minimize interference. These techniques rarely eliminate the interference. Instead, these techniques reduce the level of interference received by an internal signal of the primary instrument. One technique for reducing external interference involves moving the primary instrument to an environment having a lower level of external interference.

Some environments are worse than others with respect to external interference. A primary instrument that works within a desired emission range on the "bench" can perform outside of this desired emission range when placed at a different location. This is because external interference can couple with an internal signal and result in an increase in emissions from the primary instrument. Some environments to be avoided are those (a) near a radio or television station, (b) near a subway, (c) near high-voltage lines, (d) near motors and elevators, and (e) near instruments with large transformers. However, altering the operating location of the instrument is typically not a viable option. Therefore, alternate methods for reducing external interference must be implemented.

Another design consideration is the reduction of cross-talk. Cross-talk reduction can be achieved using a combination of RF line filters and transient suppressors on an AC power line. A significant attenuation from signals can be achieved using this technique. However, when the primary instrument is operating at RF, such filters can not be used without filtering out desired information which is carried on signals.

Interference within the primary instrument is a significant problem when RF coupling is involved. This problem can be particularly serious because innocent-looking parts of the instrument, e.g., wires or pins on a connector, can act as resonant circuits. Such parts can display enormous effective cross sections for RF pickup. To reduce this type of RF coupling, instrument designers attempt to keep leads short and avoid loops that can resonate. However, designing such instruments is often difficult because of practical and technical limitations.

The use of "ferrite beads" (described below) may help to reduce RF coupling. A ferrite bead is a ferrite material, i.e., a highly permeable magnetic material. The ferrite material slips onto a conductor, e.g., a wire or a pin on a connector, which is carrying signals. The ferrite material effectively acts as an RL low-pass filter. This ferrite material attenuates (chokes) RF emissions attempting to pass through it. Basically, the ferrite material alters the line inductance and provides impedance to high frequency signals such that high frequency energy does not emanate. However, this is not an ideal solution because it is difficult and expensive to manufacture a conductor such that the ferrite beads are precisely located on the wires within the primary instrument. It is also difficult to precisely determine the impedance and the inductance of a wire surrounded by a ferrite bead. As a result, it is difficult to accurately model the primary instrument's performance.

Another significant concern in the design of the primary instrument is the level of RF energy emissions emanating from the primary instrument. Governments have formed organizations which regulate the acceptable emission level for electronic instruments used within its governing territory. Examples of these organizations are the International Special Committee on Radio Interference (CISPER) in Europe and the Federal Communication Commission (FCC) in the United States. In order to satisfy the requirements set forth by such organizations, RF emissions from electronic instruments should be minimized.

Thus, what is needed is a method and a device for reducing RF emissions and RF interference at connectors which is reliable and can be precisely modelled.

SUMMARY OF THE INVENTION

The present invention is directed to electrical connectors which have a number of innovative features. These innovative features include encompassing the electrical connectors' sockets and pins with a lossy dielectric material such that undesirable radio frequency (RF) signals are attenuated within the lossy dielectric material without shorting the connector's pins at low frequencies. The lossy dielectric material reduces interference between connector pins and external RF signals which are in the form of conducted emissions.

The present invention is an electrical device for propagating an electrical signal which emits radio frequency electromagnetic energy, the electrical device having a medium for propagating the electrical signal and a radio frequency electromagnetic energy absorbing material, radially surrounding a portion of the medium, for attenuating the radio frequency electromagnetic energy emissions generated by the signal.

BRIEF DESCRIPTION OF THE FIGURES

The foregoing and other objects, features and advantages of the invention will be apparent from the following more particular description of the preferred embodiments of the invention, as illustrated in the accompanying drawings, wherein.

DETAILED DESCRIPTION OF THE PREFERRED EMBODIMENTS

Preferred embodiments of the present invention are now described with reference to the figures where like reference numbers indicate identical or functionally similar elements. Also in the figures, the left most digit of each reference number corresponds to the figure in which the reference number is first used. While specific steps, configurations and arrangements are discussed, it should be understood that this is done for illustrative purposes only. A person skilled in the relevant art will recognize that other steps, configurations and arrangements can be used without departing from the spirit and scope of the invention.

The present invention is directed to electrical connectors, hereafter "connectors" which have a number of innovative features. These innovative features include encompassing the connectors' sockets and pins with a lossy dielectric material such that undesirable radio frequency (RF) signals, hereafter "signals", are attenuated within the lossy dielectric material without shorting the connector's pins at low frequencies. The lossy dielectric material reduces interference between connector pins and external signals in the form of conducted emissions.

Figure 1:
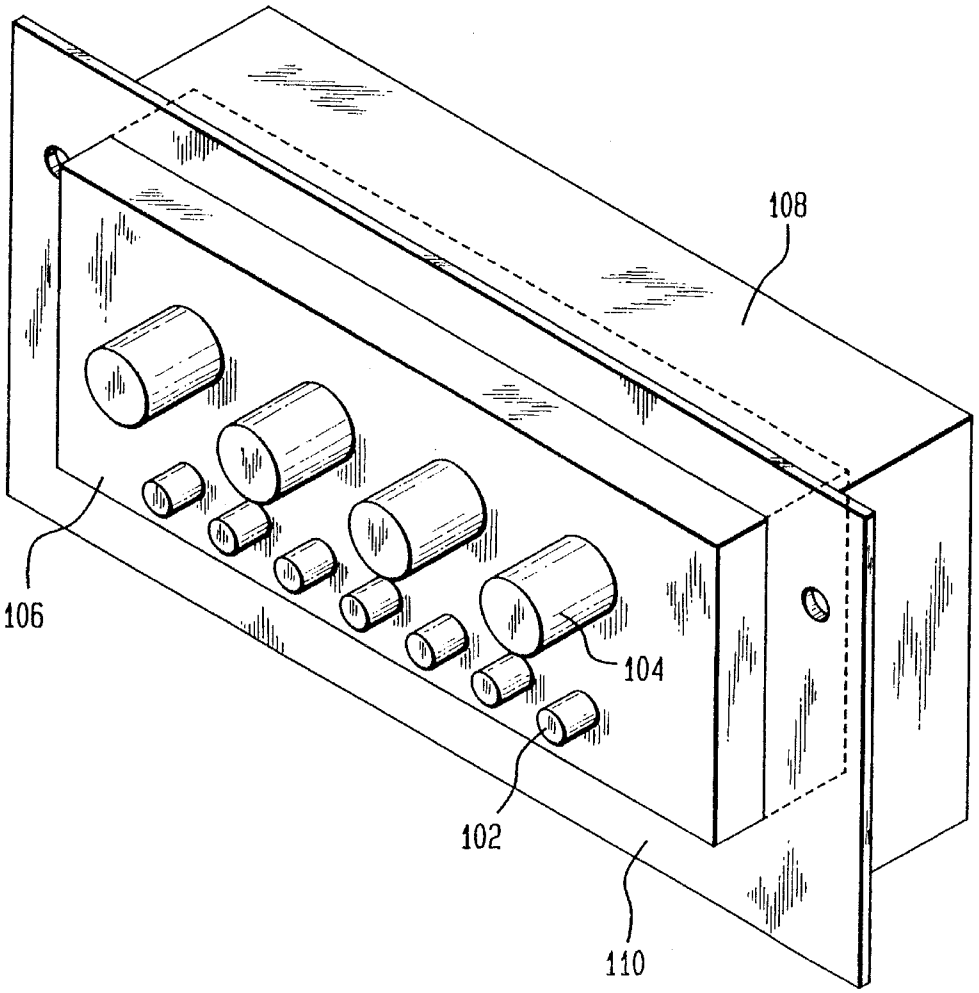
FIG. 1 is a perspective view of a male portion of a D-sub connector according to a preferred embodiment of the present invention.

The present invention is described herein with respect to a D-subminiature type electrical connector, hereafter "D-sub connector." It will be apparent to persons skilled in the relevant art that alternate connectors can be substituted for the D-sub connector. FIG. 1 is an a perspective view of a male portion of a D-sub connector according to a preferred embodiment. Such a D-sub connector can be a part of many types of electrical instruments, e.g., a linear amplifier. The D-sub connector 100 is a multi-pin connector capable of transferring a multitude of signals from one electrical instrument to another.

Figure 2:
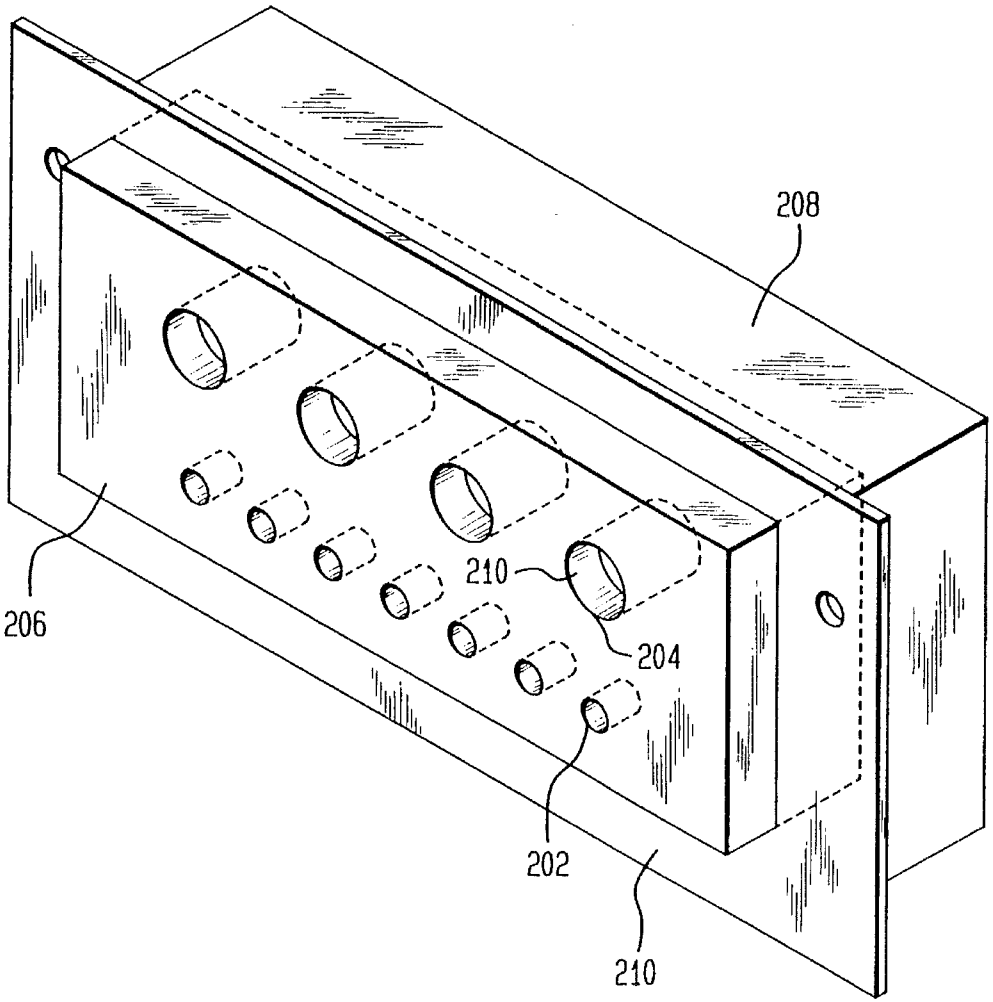
FIG. 2 is a perspective view of a female portion of a D-sub connector according to a preferred embodiment of the present invention.

D-sub connectors have a male portion 100 and a female portion 200. FIG. 2 is a perspective view of the female portion 200 of a D-sub connector. Pins from the male portion 100 are designed to mate with the sockets 202, 204 in the female portion 200, described below. Small connector pins 102 on the male portion 100 can carry control/data signals between electrical instruments. Large connector pins 104 can transfer power signals and/or RF input/output (I/O) signals between electrical instruments. It will be apparent to persons skilled in the relevant art that alternate pin designs can be used without departing from the spirit and scope of the present invention.

As stated above, the female portion 200 of the D-sub connector has sockets 202, 204 for accepting, i.e., mating with, pins 102, 104 of the male portion 100 of the D-sub connector. The sockets 202, 204 are typically coated with a material having a high conductivity. The pins 102, 104 contact the socket coating. The contact between the pins 102, 104 and the sockets 202, 204 enables a signal to pass between the male portion 100 of the D-sub connector and the female portion 200 of the D-sub connector.

Typically, the small pins 102 and the large pins 104 of the male portion 100 are partially surrounded by a rigid plastic material. The plastic material is located within the connector housing 108. A face plate 110 is connected to the connector housing 108. The face plate can intersect the plastic material at an end where the pins 102, 104 protrude. Alternately, the face plate can intersect the plastic material such that the plastic material extends on both sides of a plane defined by the plastic material. This rigid plastic material secures the pins 102, 104 within a male connector housing 108 and prevents the pins 102, 104 from bending or otherwise becoming misaligned. Maintaining the alignment of the pins 102, 104 is extremely important. If the alignment of the connector pins 102, 104 is altered, the pins 102, 104 will not mate with the female section 200 of the D-sub connector.

As stated above, the material used to secure the pins 102, 104 is typically a rigid plastic material. However, such rigid plastic material does not attenuate RF emissions passing through it. A significant feature of the present invention is the discovery that replacing the plastic material with RF energy absorbing material 106 significantly reduces RF emissions and RF coupling to and from electrical connectors. The RF energy absorbing material 106 can be located in the same position as the plastic material, described above.

Similarly, the female portion 200 of the D-sub connector typically includes a plastic material which is molded to provide the sockets 202, 204, within a female connector housing 208. Another significant feature of the present invention is the use of RF energy absorbing material 206 in the female portion 200 of the D-sub connector to significantly reduce RF emissions and RF coupling. In addition, the same RF energy absorbing material 106, 206 can be used in both the male portion 100 and the female portion 200 of the D-sub connector.

Figure 3:
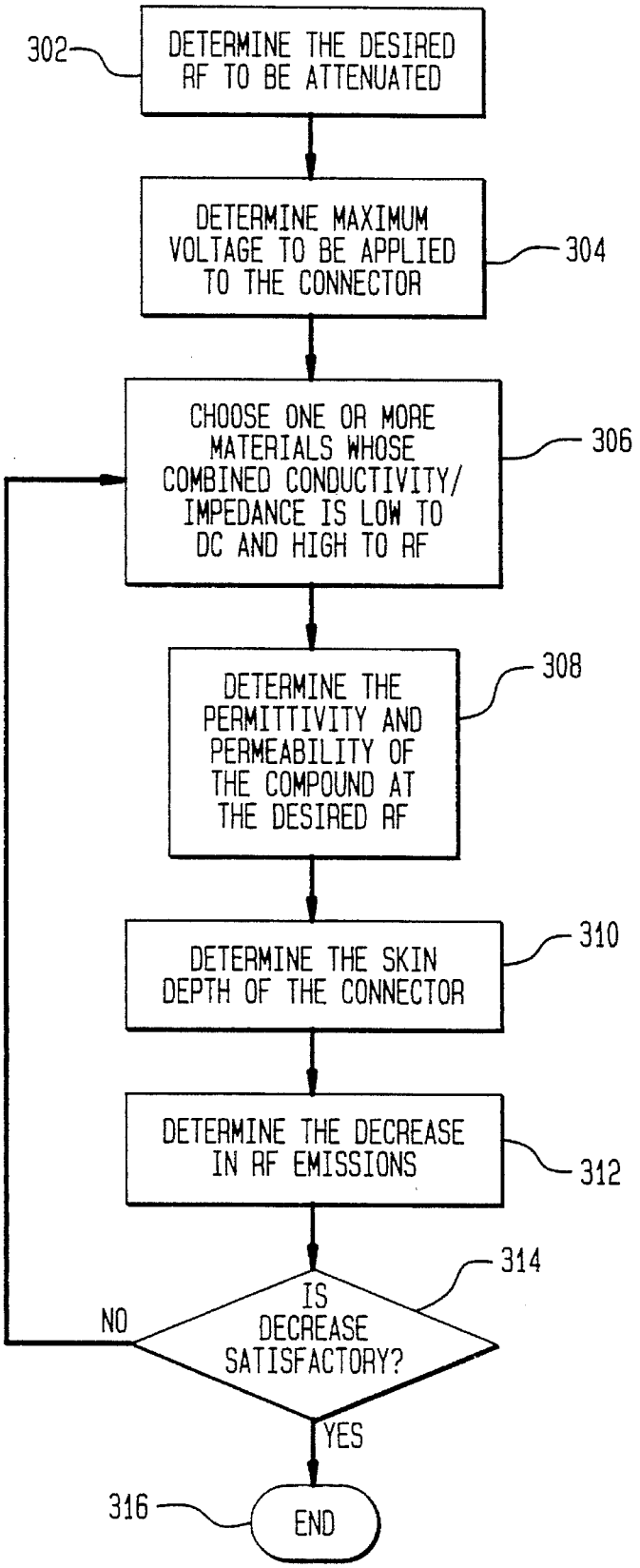
FIG. 3 is a flowchart of a preferred method of selecting a radio frequency (RF) electromagnetic material according to a preferred embodiment of the present invention.

FIG. 3 is a flow chart detailing a preferred method for determining a material to use as the RF energy attenuating material 106, 206. In step 302 the RFs to be attenuated are determined by an instrument designer. The frequencies chosen will affect which RF energy absorbing material 106, 206 is chosen by the designer in step 306 to absorb RF energy. In addition, the necessary width of the RF energy absorbing material 106, 206 is related to the chosen frequency, as described above. Frequently, electrical instruments are designed to operate at a specific frequency. RF emissions from the primary instrument typically occur at this frequency and, in addition, at first, second, third, etc. order harmonics surrounding this frequency. Oftentimes, radiated spurious emissions at these harmonic frequencies are undesirable because of government emission standards, discussed above. These frequencies can be chosen by the instrument designer in step 302 as the RF to be attenuated.

In step 304, the designer determines the maximum voltage that can be applied to the connector, i.e., the connector's voltage rating. When choosing the RF energy absorbing material 106, 206 the connector's 100, 200 maximum voltage rating is a significant consideration. If an excessive voltage is applied to the RF energy absorbing material 106, 206, saturation can occur. When saturation occurs the RF energy absorbing material's 106, 206 ability to absorb RF energy decreases significantly. The RF power rating and maximum direct current (DC) voltage for a variety of materials is available from a variety of sources, such as Shackelford & Alexander, *Material Science Handbook*, CRC Press 1992, which is herein incorporated in its entirety.

In step 306 the designer chooses a RF energy absorbing material 106, 206 or a combination of materials, e.g., a polymer, based upon several considerations, including: the RF to be attenuated as determined in step 302; the maximum voltage to be applied to the RF energy absorbing material 106, 206, as determined in step 304; and the conductivity level of the RF energy absorbing material or polymer 106, 206. The conductivity must be low enough to prevent the RF energy absorbing material 106, 206 from forming a short circuit between the pins 102, 104 of the male portion 100 of the D-sub connector or between the sockets 202, 204 of the female portion 200 of the D-sub connector. The conductivity must be high enough to ensure that the RF energy absorbing material 106, 206 will attenuate signals passing through it. That is, the RF energy absorbing material 106, 206, selected in step 306 must be "lossy", discussed below, and must have a high loss tangent, discussed below.

In the preferred embodiment, a lossy dielectric material, e.g. iron impregnated silicon, is selected as the RF energy absorbing material 106, 206 in step 306. A "lossy" material has a non-zero conductivity, $\sigma$. The amount of signal attenuation by a lossy material 106, 206 is dependent upon the signal frequency. In general, the chosen RF energy absorbing material 106, 206 will have a high impedance at the frequency chosen to be attenuated in step 302, e.g., at RF. However, at low frequencies the impedance will be low.

As stated above, the male portion 100 of the connector can have multiple pins. Low frequency signals or direct current (DC) signals can be present on one or more of these pins 102, 104. Therefore, the RF energy absorbing material 106, 206 must be chosen such that the impedance of the RF energy absorbing material 106, 206 at low frequencies is high enough to prevent the RF energy absorbing material 106, 206 from forming a short circuit between the pins 102, 104 of the connector when low frequency signals are present. A lossy dielectric material has a high impedance, and therefore is a poor conductor of direct current. As such, in the preferred embodiment a lossy dielectric material is chosen as the RF energy absorbing material 106, 206.

In step 308, the permittivity, $\epsilon$, of the RF energy absorbing material 106, 206 is determined. The permittivity of a material is a measure of its ability to store electric energy. Permittivity values for many materials are well known and can be found in a variety of reference manuals. For example, a table containing the permittivity values for many materials is found in, Hayt, *Engineering Electromagnetics*, page 508 (4th ed. 1981), which is herein incorporated by reference in its entirety. The technique for determining the permittivity of a material will be apparent to persons skilled in the relevant art.

In step 310, the width of the RF energy absorbing material 106, 206 between the pins 102, 104 is determined. When signals pass through an RF energy absorbing material 106, 108, the amplitude of the signal decreases as the signal passes through the RF energy absorbing material 106, 108. The maximum skin depth is limited by the distance between the pins 102, 104 and the physical size of the connector 100, 200.

Additional details concerning RF energy absorbing materials are found in U.S. Pat. No. 4,948,922 to Varadan et al., U.S. Pat. No. 4,889,750 to Wiley, and U.S. Pat. No. 4,371,742 to Manly, which are all herein incorporated by reference in their entirety.

In step 312, the ideal decrease in RF emissions is determined. A technique for determining whether a RF energy absorbing material 106, 206 is suitable for attenuating signals in an electrical instrument is given below. Certain material characteristics are used in the equations (1)–(19), described below, to determine the level of attenuation of the RF energy absorbing material 106, 206.

The variables used in equations (1)–(19) are now defined. "H" is the magnetic field intensity whose units are ampere/meter (A/m). "$\sigma$" is the conductivity of a material having the units of mho/meter. "$\omega$" is the radian frequency of a signal having the units of radian/second (rad/s). "$\epsilon$" is the permittivity of a material having the units of farad/meter (F/m). "$\mu$" is the permeability of a material having the units of Henry/meter (H/m). "$\hat{E}$" is an electric field intensity having the units of volt/meter (V/m). "z" is a distance in the z-axis having the units of meters (m). "$\alpha$" is the attenuation constant of a material having the units of neper/meter (Np/m). "$\gamma$" is the propagation constant having the complex units of neper/meter ($m^{31\ 1}$). "f" is the frequency of a signal having the units of hertz (Hz). "$\delta$" is termed the skin depth of a material having the units of meters (m).

The values used in the following equations are approximations and are used to illustrate a technique for determining the RF attenuation of a signal passing through a RF energy absorbing material 106, 206.

A requirement for the RF energy absorbing material 106, 206 of the present invention is that the amplitude of a signal decreases as the signal propagates through the RF energy absorbing material 106, 206, i.e., the RF energy absorbing material 106, 206 attenuates the signal. As described above, a lossy material is a material which reduces the amplitude of a signal passing through it. A lossy material has a conductivity (a) which is not equal to zero. When a signal passes through a lossy material the signal can be characterized by Ampere's law which can be written as shown in equation (1):

$$\begin{aligned} \nabla \times H &= (\sigma + j\omega\epsilon)E \\ &= j\omega\epsilon\left(1 - j\frac{\sigma}{\omega\epsilon}\right)E \end{aligned} \quad (1)$$

The term $\sigma/\omega\epsilon$ shown in equation (1) is referred to as the loss tangent of the material. The loss tangent is a function of frequency. Values of the loss tangent can be calculated from values found in tables in a variety of material handbooks, e.g., Shackelford & Alexander, *Material Science Handbook*, CRC Press 1992.

Materials can be classified according to whether the loss tangent is significantly larger than one or whether the loss tangent is significantly smaller than one; that is, $$\frac{\sigma}{\omega\epsilon} << 1 \quad \text{good dielectric} \tag{2}$$

$$\frac{\sigma}{\omega\epsilon} >> 1 \quad \text{good conductor} \tag{3}$$

As stated above, a lossy dielectric material is chosen as the RF energy absorbing material 106, 206. The lossy material 106, 206 surrounds the pins 102, 104 and the sockets 202, 204 of the D-sub connector. Signals travelling through the pins 102, 104 and the socket 202, 204 will emit RF electromagnetic energy radially into the lossy material 106, 206. The lossy material 106, 206 has material constants corresponding to the lossy material's 106, 206 permittivity ($\epsilon$), permeability ($\mu$), and conductivity ($\sigma$). The electric field generated by an signal can be written as shown in equation (4).

$$\hat{E}=E_m e^{-\alpha z}\cos(\omega t-\beta z)a_x \tag{4}$$

where $E_m$ is the magnitude of the field. As the signal travels through the lossy material 106, 206, its amplitude will be attenuated by the factor $e^{-\alpha z}$. Therefore, over a distance of:

$$\delta=1/\alpha \tag{5}$$

the magnitude of the signal will have been reduced to 1/e or approximately 37 percent of its initial amplitude. The quantity $\delta$ is termed the skin depth or depth of penetration of the lossy material 106, 206.

For good lossy dielectrics, the skin depth becomes extremely small as the signal frequency increases. Effective electromagnetic shielding may be provided by having the lossy dielectric material 106, 206 width equal to at least several skin depths, $\delta$. That is, if a signal is incident normally on the surface of a lossy dielectric material 106, 206, the lossy dielectric material 106, 206 need only be a few skin depths, $\delta$, in thickness in order to effectively shield electronic devices on one side of the lossy material 106, 206 from the affects of the signals on the other side of the lossy material 106, 206. This is because of the rapid attenuation of the wave emanating from the conductor, i.e., the pins 102, 104, and the sockets 202, 204, into the lossy material 206.

As an example, if in step 302 the frequency chosen to be attenuated is 1 gigahertz (GHz) and the RF energy absorbing material 106, 206 is iron impregnated silicon, the following calculations show the amount of attenuation of a signal passing through one millimeter (mm) of iron impregnated silicon.

$\omega$ is equal to $2\pi f$, therefore the radian frequency, $\omega$, of the signal is equal to $6.28(10^9)$ radians. The permeability, $\mu$, is equal to the product of the permeability of free space, $\mu_o$, and the relative permeability of iron impregnated silicon, $\mu_r$, as $$\mu=\mu_o\mu_r \tag{6}$$

shown in equation (6).

The permittivity, $\epsilon$, is equal to the product of the permittivity of free space, $\epsilon_o$, and the relative permittivity of iron impregnated silicon, as shown in equation (7).

$$\epsilon=\epsilon_o\epsilon_r \tag{7}$$

Based upon material property tables which can be found in, for example, *Engineering Electromagnetics*, Hayt on pages 508–509, the calculations of the permeability and the permittivity of iron impregnated silicon are shown in equations (8) and (9).

$$\mu=3500(12.6(10^{-7}))=4.41(10^{-3})H/m \tag{8}$$

As such, $$\epsilon=12(8.85(10^{-12}))=106(10^{-12})F/m \tag{9}$$

$$\sigma/\omega\epsilon=1800\ Np/m \tag{10}$$

The propagation constant, $\gamma$, has the formula given in equation (11). For iron impregnated silicon the calculation of the propagation constant is shown in equations (12)–(16).

$$\gamma=j\omega\sqrt{\mu\epsilon}\ \sqrt{1-j\sigma/\omega\epsilon}\ \ \mathrm{m}^{-1} \tag{11}$$

$$\gamma=j(6.28(10^9))\sqrt{4.41(10^{-3})\cdot 106(10^{-12})}\ \sqrt{1-j1800}\ \ \mathrm{m}^{-1} \tag{12}$$

$$\gamma=j(6.3\cdot 10^9)\sqrt{468(10^{-15})}\ \sqrt{1-j1800}\ \ \mathrm{m}^{-1} \tag{13}$$

$$\gamma=j4300\sqrt{1-j1800}\ \rightarrow j4300(30-j30)\mathrm{m}^{-1} \tag{14}$$

$$\begin{aligned}\gamma &= 129(10^3)j+129(10^3)\mathrm{m}^{-1} \\ &= J\beta+\alpha\end{aligned} \tag{15}$$

$$\alpha = 129(10^3)\mathrm{Np/m} \tag{16}$$

The skin depth, $\epsilon$, is equal to $1/\alpha$, or $7.75(10^{-6})$. As stated above, the signal is attenuated such that the signal amplitude is reduced to approximately 37%, $e^{-1}$, of its original value after travelling through one skin depth, $\epsilon$, of material. The decibel (dB) reduction of the signal for each skin depth of penetration is given in equation (17).

$$\text{Voltage Gain}_{dB}\equiv 20\log_{10}(v_{out}/v_{in}) \tag{17}$$

When the signal output is only 36.7%, i.e., $e^{-1}$, of the signal input the decibel reduction is shown in equation (18).

$$20\log_{10}(0.367)\approx -8.7\ \mathrm{dB} \tag{18}$$

That is, the signal is reduced by approximately 8.7 dB for each skin depth the signal travels through. If the iron impregnated silicon has a width of 1 mm the number of skin depths the signal passes through is shown in equation (19).

$$\frac{\text{width}}{\delta}=\frac{10^{-3}}{7.75(10^{-6})}=129 \tag{19}$$

That is, a 1 GHz signal passing through 1 mm of iron impregnated silicon is equivalent to passing through 129 skin depths.

These calculations represent the ideal attenuation. Therefore, ideally, the signal will be reduced by over 1100 dB (129 times 8.7 dB). The actual signal reduction will be less than this ideal case, but the signal reduction will be significant.

In step 314 the user decides whether the RF attenuation of the chosen material 106, 206 is satisfactory. If the RF attenuation is satisfactory then the material choice is completed as shown in step 316. Otherwise, a new material is chosen and steps 306–314 are repeated.

The optimal conductivity of the RF energy absorbing material 106, 206, i.e., a high loss tangent and insulating at low frequency signals, is a delicate tradeoff. Additional methods for determining a suitable RF energy absorbing material will be apparent to persons skilled in the relevant art.

In conjunction with placing an RF energy absorbing material 106, 206 between the D-sub connector pins 102, 104 (or the connector sockets 202, 2040 and the D-sub connector housing 108, 208 other techniques can be utilized to further increase signal attenuation, as shall now be described with reference to FIGS. 4 and 5.

Figure 4:
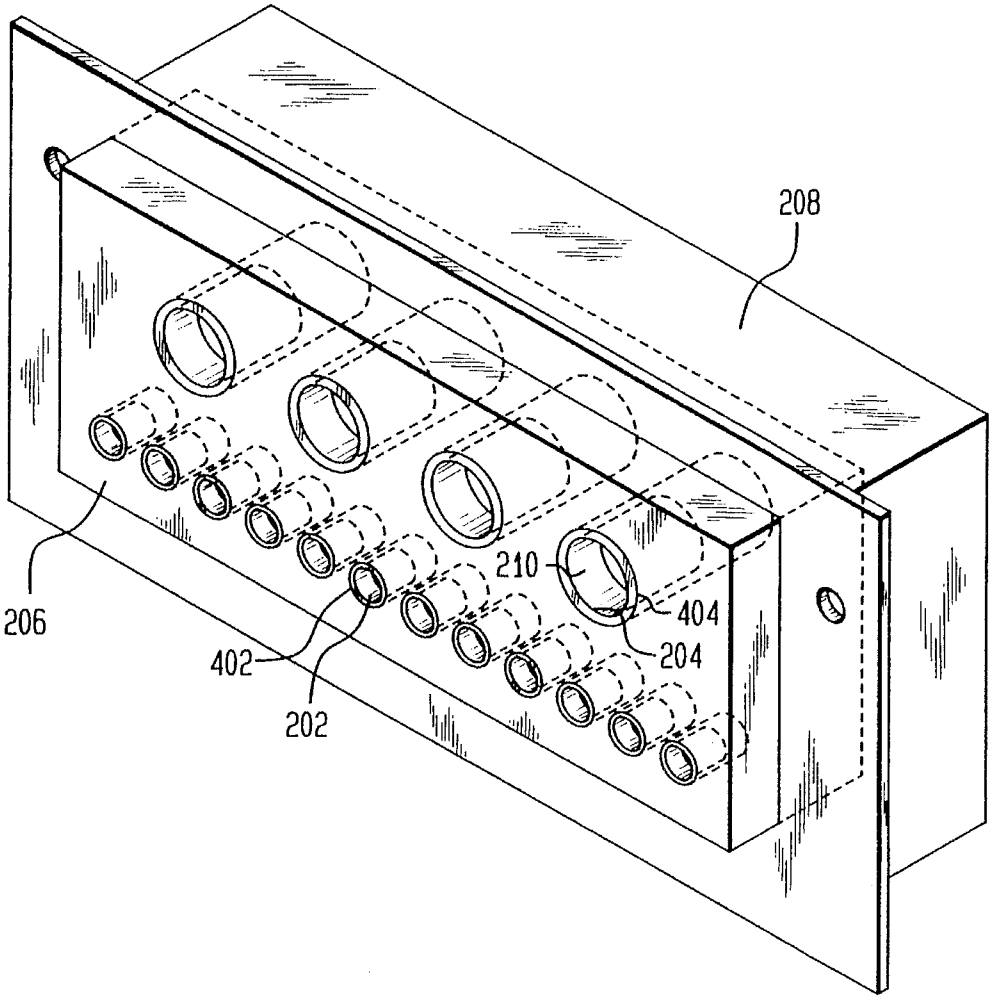
FIG. 4 is a perspective view of a female portion of a D-sub connector having a conductive sleeve according to an alternate embodiment of the present invention.

FIG. 4 is a perspective view of a female portion of a D-sub connector 400 according to an alternate embodiment of the present invention. A coaxial ferrite sleeving 402, 404 surrounds the socket coating 210 for each socket 202, 204. The coaxial ferrite sleeving 402, 404 is a coaxial device having thin layer of ferrite material as the outer layer of the coaxial device. The coaxial ferrite sleeving 402, 404 is surrounded by a RF electromagnetic energy absorbing material 208, discussed above. The coaxial ferrite sleeving 402, 404 shields the sockets 202, 204 thereby further attenuating signals emitted from the conductive path formed by the pins 102, 104 and the sockets 202, 204.

The coaxial ferrite sleeving 404 improves RF energy attenuation. The combination of the coaxial ferrite sleeving 404 and the lossy material 106, 206 act as a controllable and predictable LC low-pass filter. The coaxial ferrite sleeve 402, 404 provides the filter's inductance and the lossy material 106, 206 provides the filter's capacitance. The coaxial ferrite sleeve 402,404 and RF absorbing material 106, 206 combination form a high series impedance at RF and forms a low series impedance at DC. The detailed operation of the coaxial sleeving will be apparent to persons skilled in the relevant art.

Figure 5:
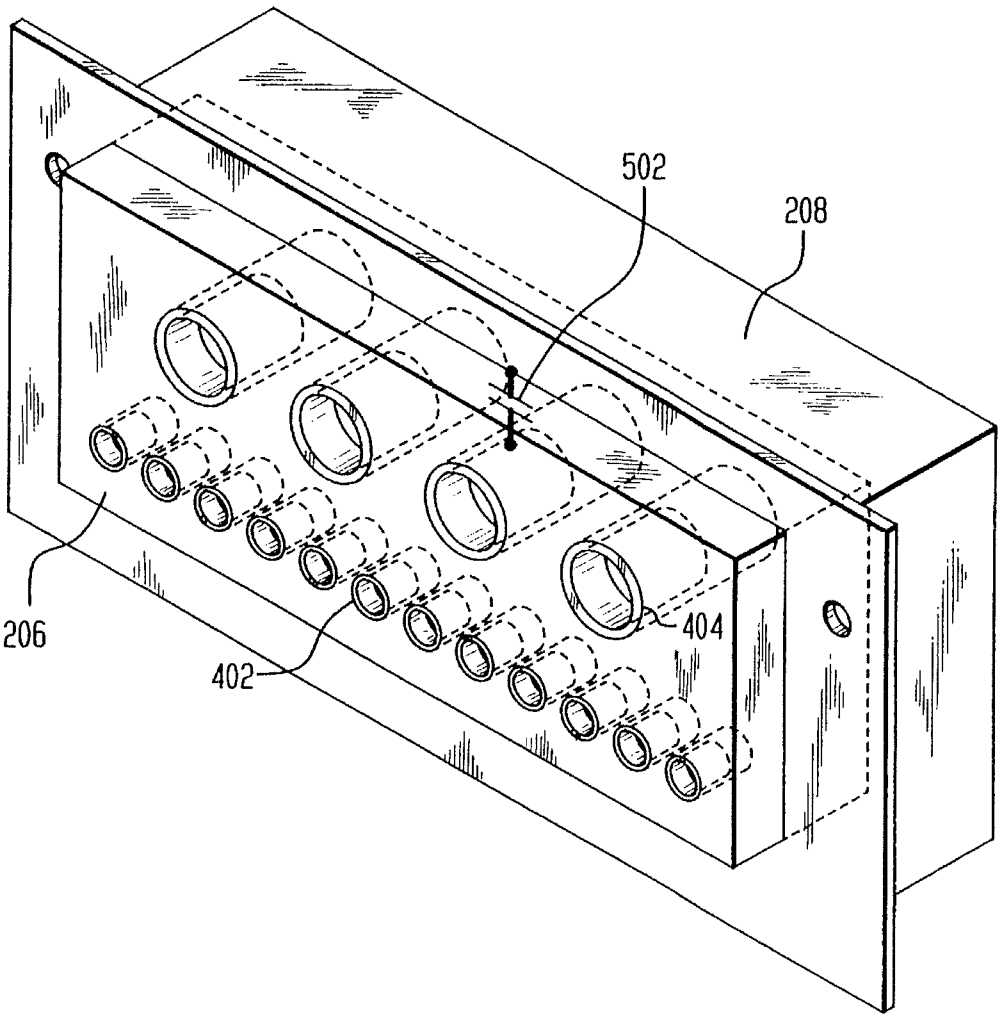
FIG. 5 is a perspective view of a female portion of a D-sub connector having a RF bypass capacitor according to an alternate embodiment of the present invention.

FIG. 5 is a perspective view of a female portion of a D-sub connector 500 according to an alternate embodiment of the present invention. To further increase signal attenuation, the coaxial ferrite sleeving 402, 404, described above, can surround the socket coating 210 of the female portion 210 of the connector. The coaxial ferrite sleeving is physically connected to the connector housing via a bypass filter capacitor 502.

In FIG. 5 one bypass filter capacitor 502 is illustrated, however bypass filter capacitors can be physically coupled to each coaxial sleeve to reduce RF emissions. Typically, a connector housing 208 is grounded. In an alternate embodiment of the present invention the bypass filter capacitor 502 connects the coaxial ferrite sleeve 402, 404 to the connector housing 208 thereby grounding RF emissions on the coaxial ferrite sleeve 402, 404. A grounded coaxial ferrite sleeve 402,404 generally increases RF attenuation by providing a RF shunt for extraneous signals on a the coaxial sleeve. The detailed operation of the RF bypass capacitor will be apparent to persons skilled in the relevant art.

While the invention has been particularly shown and described with reference to a preferred embodiment and several alternate embodiments thereof, it will be understood by persons skilled in the relevant art that various change in form and details can be made therein without departing from the spirit and scope of the invention.

What is claimed is:

1. An electrical device for propagating an electrical signal which emits radio frequency (RF) electromagnetic energy, the electrical device comprising:

a medium for propagating the electrical signal, wherein said medium comprises an electrically conducting pin and an electrically conducting socket for providing an electrical path via said medium;

a lossy dielectric material radially surrounding a portion of said medium, wherein said lossy dielectric material has capacitance (C); and a coaxial ferrite sleeving positioned between said medium and said lossy dielectric material, wherein said coaxial ferrite sleeving has inductance (L), and wherein said lossy dielectric material and said coaxial ferrite sleeving combine to form a LC low-pass filter for attenuating the RF electromagnetic energy emission generated by the electrical signal.

2. The electrical device of claim 1, wherein said electrical device is an electronic connector.

3. The electrical device of claim 1, wherein said electrical device is a D-subminiature connector.

4. The electrical device of claim 1, wherein said lossy dielectric material is a polymer.

5. The electrical device of claim 1, wherein said medium comprises two or more of said electrically conducting pins and two or more of said electrically conducting sockets wherein said lossy dielectric material electrically insulates said two or more pins from each other and insulates said two or more sockets from each other.

6. An electrical device for propagating an electrical signal which emits radio frequency (RF) electromagnetic energy, the electrical device comprising:

a medium for propagating the electrical signal, wherein said medium comprises an electrically conducting pin and an electrically conducting socket for providing an electrical path via said medium;

a lossy dielectric material radially surrounding a portion of said medium, wherein said lossy dielectric material has capacitance (C);

a coaxial ferrite sleeving positioned between said medium and said lossy dielectric material, wherein said coaxial ferrite sleeving has inductance (L), and wherein said lossy dielectric material and said coaxial ferrite sleeving combine to form a LC low-pass filter for attenuating the RF electromagnetic energy emission generated by the electrical signal; and a housing for encompassing said medium, said coaxial ferrite sleeving and said lossy dielectric material.

7. The electrical device of claim 6, wherein said housing is electrically grounded and said electrical device further comprises a bypass filter capacitor coupled between said housing to said coaxial ferrite sleeving, for attenuating the RF electromagnetic energy by grounding said coaxial ferrite sleeving.

8. The electrical device of claim 7, wherein said electrical device is an electronic connector.

9. The electrical device of claim 7, wherein said electrical device is a D-subminiature connector.

10. The electrical device of claim 7, wherein said lossy dielectric material is a polymer.

11. The electrical device of claim 7, wherein said medium comprises two or more of said electrically conducting pins and two or more of said electrically conducting sockets wherein said lossy dielectric material electrically insulates said two or more of said pins from each other and insulates said two or more of said sockets from each other.

12. A method for reducing radio frequency (RF) electromagnetic emissions from an electronic signal, the method comprising:

(1) determining the RF to be attenuated;

(2) determining the maximum voltage to be applied to an electronic device;

(3) choosing one or more materials whose combined conductivity is low at a low frequency signal and whose combined conductivity is high to said RF determined in step (1);

(4) determining the permittivity and the permeability of said one or more materials at said RF determined in step (1);

(5) determining a decrease in RF emissions from the electronic signal; and (6) repeating steps (3)–(5) until said decrease in RF emissions is within a desired range.

* * * * *